US007568406B2

(12) United States Patent
Booher et al.

(10) Patent No.: US 7,568,406 B2
(45) Date of Patent: Aug. 4, 2009

(54) ADJUSTABLE PEDAL SYSTEM WITH RATIO MODIFIER

(75) Inventors: Jason Allen Booher, Atlanta, MI (US); James Robert Allen, Bellaire, MI (US); Brian John Eckerle, Petoskey, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 0 days.

(21) Appl. No.: 11/782,137

(22) Filed: Jul. 24, 2007

(65) Prior Publication Data

US 2009/0025505 A1 Jan. 29, 2009

(51) Int. Cl.
*G05G 1/30* (2008.04)
*G05G 1/34* (2008.04)

(52) U.S. Cl. ..... 74/512; 74/522; 74/560; 74/562; 180/334

(58) Field of Classification Search ..... 74/512, 74/513, 522, 560, 562.5; 180/320, 334, 335; *G05G 1/30, G05G 1/34*
See application file for complete search history.

(56) References Cited

U.S. PATENT DOCUMENTS 2,936,867 A * 5/1960 Perry ..... 477/216
5,078,024 A * 1/1992 Cicotte et al. ..... 74/512
5,460,061 A * 10/1995 Redding et al. ..... 74/512
6,247,381 B1 6/2001 Toelke et al.
6,289,761 B1 9/2001 Reynolds et al.
6,352,007 B1 3/2002 Zhang et al.
6,367,348 B1 4/2002 Toelke et al.
6,367,349 B1 4/2002 Allen et al.
6,510,761 B2 1/2003 Zhang et al.
6,516,683 B2 2/2003 Sundaresan et al.
6,598,495 B2 7/2003 Elgart
6,609,438 B1 * 8/2003 Bigham et al. ..... 74/560
6,739,212 B2 5/2004 Flynn
6,758,115 B2 7/2004 Allen et al.
6,840,130 B2 1/2005 Toelke et al.
6,880,427 B2 4/2005 Allen et al.
6,925,904 B2 8/2005 Sundaresan et al.
7,111,524 B2 9/2006 Kiczek et al.
7,219,575 B2 5/2007 Flynn
2006/0248978 A1 * 11/2006 Prat Terradas et al. ..... 74/560

* cited by examiner

*Primary Examiner*—David M. Fenstermacher
*Assistant Examiner*—Timothy J Murphy
(74) *Attorney, Agent, or Firm*—Porter, Wright, Morris & Arthur LLP; Richard M. Mescher; Dean B. Watson

(57) ABSTRACT

An adjustable control pedal includes an upper arm and a lower arm carrying a pedal. The lower arm can be selectively moved relative to the upper arm to adjust the position of the pedal between a forward position and a rearward position. A control pin is operably connected to the upper arm for rotation with the upper arm to supply a control signal when force is applied to the pedal. An adjuster is operably connected to the control pin to adjust the position of the control pin relative to the pivot axis so that a ratio of a distance between the pivot axis and the pedal and a distance between the pivot axis and the control pin remains constant as the pedal is adjusted between the forward position and the rearward position.

17 Claims, 4 Drawing Sheets

ADJUSTABLE PEDAL SYSTEM WITH RATIO MODIFIER

CROSS-REFERENCE TO RELATED APPLICATIONS

Not Applicable

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to an improved control pedal for a motor vehicle and, more particularly, to a control pedal for a motor vehicle which is selectively adjustable to desired positions.

BACKGROUND OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. A front seat of the motor vehicle is typically mounted on tracks so that the seat is forwardly and rearwardly adjustable along the tracks to a plurality of positions so that the driver can adjust the front seat to the most advantageous position for working the control pedals.

This adjustment method of moving the front seat along the tracks generally fills the need to accommodate drivers of various size, but it raises several concerns. First, this adjustment method still may not accommodate all drivers due to very wide differences in anatomical dimensions of drivers. Second, the position of the seat may be uncomfortable for some drivers as it nears the steering wheel. Therefore, it is desirable to have an additional or alternate adjustment method to accommodate drivers of various sizes.

Many proposals have been made to selectively adjust the position of the control pedals relative to the steering wheel and the front seat in order to accommodate drivers of various sizes. For example, see U.S. Pat. Nos. 3,643,525, 3,643,524, 5,632,183, 5,697,260, 5,722,302, 5,819,593, 5,937,707, 5,964,125, and 6,609,438, the disclosures of which are expressly incorporated herein in their entirety by reference, which each disclose an example of an adjustable control pedal assembly. While these adjustable pedal assemblies may adequately adjust the position of the control pedal to accommodate drivers of various size, the "feel" of the pedal to the driver changes depending on the adjusted position of the pedal. More specifically, the initial force required to depress the pedal changes. This change is due to the fact that the ratio of the distance between the pedal pivot axis and the pedal and the distance between the pedal pivot axis and the control pin changes as the position of the pedal is adjusted.

Many proposals have been made to obtain adjustable pedal assemblies with constant ratio, that is, the ratio stays the same as the pedal is adjusted between a full forward and a full rearward position, so that the feel of the pedal to the driver remains the same regardless of the adjusted position of the pedal. For example, see U.S. Pat. Nos. 3,643,525, 3,643,524 and 5,913,946, the disclosures of which are expressly incorporated herein in their entirety by reference, which each disclose an example of an adjustable control pedal assembly which attempts to obtain constant ratio. While these adjustable pedal assemblies may maintain a constant ration, they each require a rather complex mechanism that is relatively expensive to produce and/or result in a relatively large package size.

Accordingly, there is a need in the art for an adjustable control pedal assembly which maintains a constant ratio and is relatively simple and inexpensive to produce without an overly large package size.

SUMMARY OF THE INVENTION

The present invention provides an adjustable pedal system which overcomes at least some of the above-noted problems of the related art. According to the present invention, an adjustable control pedal comprises, in combination, an upper arm pivotable about a stationary pivot axis and a lower arm carrying a pedal and operably connected to the upper arm so that the lower arm pivots the upper arm about the pivot axis when force is applied to the pedal. The lower arm is operatively connected to said upper arm for selected movement relative to the upper arm to adjust the position of the pedal between a forward position and a rearward position. A control pin is operably connected to the upper arm for rotation with the upper arm as the upper arm pivots about the pivot axis when force is applied to the pedal. An adjuster is operably connected to the control pin to adjust the position of the control pin relative to the pivot axis so that a ratio of a distance between the pivot axis and the pedal and a distance between the pivot axis and the control pin remains constant as the pedal is adjusted between the forward position and the rearward position.

According to another aspect of the present invention, an adjustable control pedal comprises, in combination, an upper arm pivotable about a stationary pivot axis and a lower arm carrying a pedal and operably connected to the upper arm so that the lower arm pivots the upper arm about the pivot axis when force is applied to the pedal. The lower arm is operatively connected to said upper arm for selected movement relative to said upper arm to adjust the position of the pedal between a forward position and a rearward position. A link is pivotally attached to the upper arm and a control pin is secured to the link for providing a control signal. Movement of the lower arm relative to the upper arm pivots the link to adjust the position of the control pin relative to the pivot axis so that a ratio of a distance between the pivot axis and the pedal and a distance between the pivot axis and the control pin remains constant as the pedal is adjusted between the forward position and the rearward position.

According to yet another aspect of the present invention, an adjustable control pedal comprises, in combination, an upper arm pivotable about a stationary pivot axis and a lower arm carrying a pedal and operably connected to the upper arm so that the lower arm pivots the upper arm about the pivot axis when force is applied to the pedal. The lower arm is operatively connected to the upper arm for selected movement relative to said upper arm to adjust the position of the pedal between a forward position and a rearward position. The upper arm includes first and second spaced-apart members each having first and second slots therein. Guides are operably secured to the lower arm that extend into the first and second slots of the upper arm respectively that move along the first and second slots of the upper arm as the lower arm is selectively moved relative to the upper arm. The lower arm extends between the first and second members with the guides extending between the first and second members, and the guides. A link is pivotally attached to the upper arm and a control pin secured to the link for providing a control signal. Movement of the lower arm relative to the upper arm pivots the link to adjust the position of the control pin relative to the pivot axis so that a ratio of a distance between the pivot axis and the pedal and a distance between the pivot axis and the control pin remains constant as the pedal is adjusted between the forward position and the rearward position. The link includes an inner link and an outer link rigidly secured together. The outer link is located outside the first and second members and is pivotably attached to the upper arm. The inner link extends between the first and second members and has first and second spaced-apart slots formed therein. The guides extend into the first and second slots of the inner link respectively, and the guides move along the first and second slots of the inner link as the lower arm is selectively moved relative to the upper arm to rotate the link relative to the upper arm.

From the foregoing disclosure and the following more detailed description of various preferred embodiments it will be apparent to those skilled in the art that the present invention provides a significant advance in the technology of adjustable pedal systems. Particularly significant in this regard is the potential the invention affords for providing a high quality, reliable, cost effective adjustable pedal system with a constant ratio. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
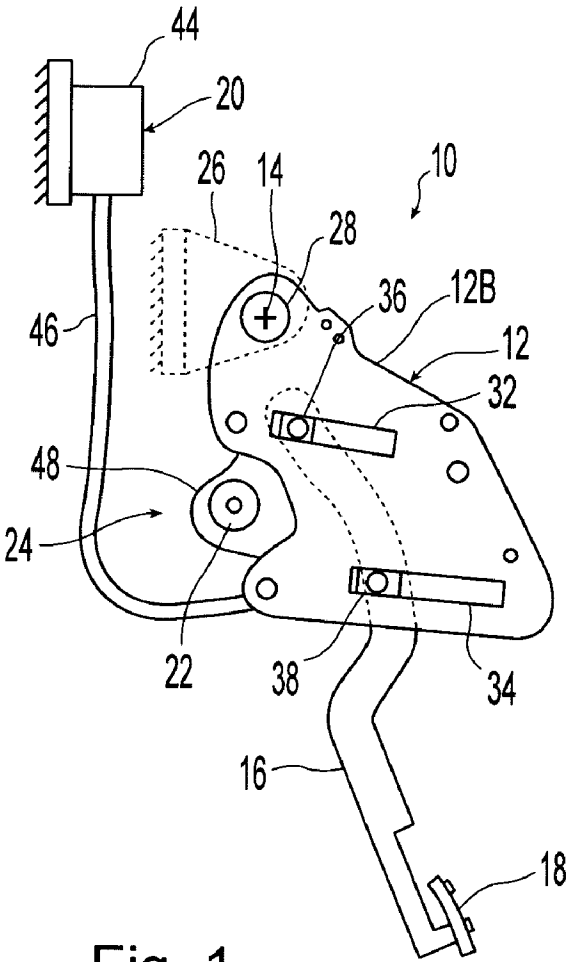
FIG. 1 is a left side elevational view of an adjustable pedal system according a preferred embodiment of the present invention.
Figure 2:
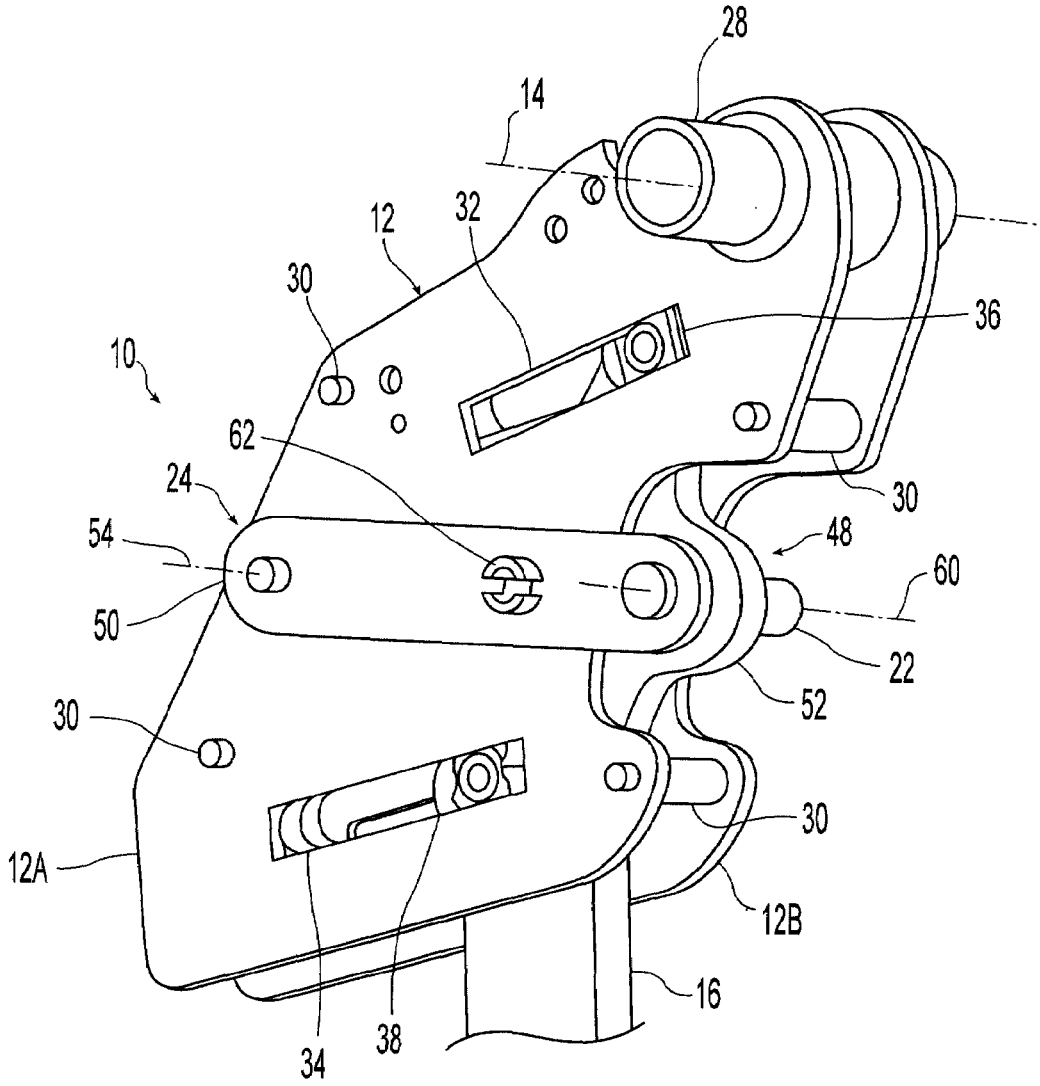
FIG. 2 is an enlarged, fragmented perspective view showing the forward and right side of the adjustable pedal system of FIG. 1.

It should be understood that the appended drawings are not necessarily to scale, presenting a somewhat simplified representation of various preferred features illustrative of the basic principles of the invention. The specific design features of the adjustable pedal system as disclosed herein, including, for example, specific dimensions, orientations, and shapes will be determined by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the adjustable pedal systems illustrated in the drawings. In general, up or upward refers to an upward direction generally within the plane of the paper in FIG. 1 and down or downward refers to a downward direction generally within the plane of the paper in FIG. 1. Also in general, forward or front refers to a direction toward the front of the vehicle, that is, toward the left generally within the plane of the paper in FIG. 1, and rearward or rear refers to a direction toward the rear of the vehicle, that is, toward the right generally within the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved adjustable control pedal disclosed herein. The following detailed discussion of various alternative and preferred embodiments will illustrate the general principles of the invention with reference to an adjustable brake pedal for use with a motor vehicle such as an automobile. Other embodiments suitable for other applications will be apparent to those skilled in the art given the benefit of this disclosure. For example, while the illustrated embodiments of the present invention are particularly adapted for use as a brake pedal, the adjustable control pedal can alternatively be adapted as a clutch, accelerator, or other desired control pedal within the scope of the present invention. Additionally, while the illustrated embodiments of the present invention are particularly adapted for use with an automobile, it is noted that the present invention can be utilized with any vehicle having at least one foot operated control pedal including trucks, buses, vans, recreational vehicles, earth moving equipment and the like, off road vehicles such as dune buggies and the like, air borne vehicles, and water borne vehicles.

As best shown in FIGS. 1 to 4, the illustrated control pedal assembly 10 includes a first or upper pedal arm 12 about a fixed position or stationary pivot axis 14 and a second or lower pedal arm 16 supported by the upper pedal arm 12 and carrying a pad or pedal 18 for engagement by the foot of the motor vehicle operator. The lower pedal arm 16 is operably connected to the upper pedal arm 12 so that the lower pedal arm 16 pivots the upper pedal arm 12 about the pivot axis 14 when force is applied to the pedal 18 by the operator. The lower pedal arm 16 is also operatively connected to the upper pedal arm 12 for selected movement relative to the upper pedal arm 12 to adjust the position of the pedal 18 between a forward position and a rearward position. A drive assembly 20 is provided for moving the lower pedal arm 16 relative to the upper pedal arm 12 to adjust the position of the pedal 18 between the forward and rearward positions. The illustrated control pedal assembly 10 further includes a control connection or pin 22 operably connected to the upper pedal arm 12 for rotation with the upper pedal arm 12 as the upper pedal arm 12 pivots about the pivot axis 14 when force is applied to the pedal 18 to provide a control signal to the vehicle device to be controlled and an adjuster 24 operably connected to the control pin 22 to adjust the position of the control pin 22 relative to the pivot axis 14 when the position of the pedal 18 is adjusted so that a ratio (L/R) remains constant as the pedal 18 is adjusted between the forward position and the rearward position. The constant ratio (L/R) is the ratio of a distance (L) between the pivot axis 14 and the pedal 18 and a distance between the pivot axis 14 and the central axis of the control pin 22.

The upper pedal arm 12 is sized and shaped for pivotal attachment to a stationary or fixed position mounting bracket 26. The mounting bracket 26 is adapted to rigidly attach the adjustable control pedal assembly 10 to a firewall or other rigid structure of the motor vehicle in a known manner. The upper pedal arm 12 is adapted for pivotal attachment to the mounting bracket 26 with an axle or pivot pin 28. Supported in this manner, the upper pedal arm 12 is pivotable relative to the fixed mounting bracket 26 about the horizontally and laterally extending pivot axis 14 formed by the central axis of the pivot pin 28.

The illustrated upper pedal arm includes first and second spaced apart members 12A, 12B which are substantially identical and are rigidly connected together to pivot together about the pivot axis 14 in unison. Each illustrated first and second member 12A, 12B is an elongate plate oriented in a vertical plane. The illustrated first and second members 12A, 12B are laterally spaced apart to form a space therebetween for receipt of an upper end of the lower pedal arm 16 as described in more detail hereinbelow. Spacer pins 30 are preferably provided between the first and second members 12A, 12B to maintain a desired distance between the first and second members 12A, 12B. The first and second members 12A, 12B are preferably formed of steel but can alternatively be formed of any other suitable material such as, for example, plastics like NYLON, aluminum, magnesium, or the like. The illustrated first and second members 12A, 12B are generally "L-shaped" having a generally vertical upper portion which generally extends downward from the pivot axis 14 and a generally horizontal lower portion which generally extends in a rearward direction from a lower end of the upper portion. The upper portion of the first and second members 12A, 12B is adapted for pivotal attachment to the mounting bracket 26 as described hereinabove.

The lower portion of the first and second members 12A, 12B is adapted for supporting the lower pedal arm 16 and for selected fore and aft movement of the lower pedal arm 16 relative to the first and second members 12A, 12B along the lower portion as described in more detail hereinafter. The illustrated lower portion has a pair of vertically spaced apart elongate openings or slots 32, 34 formed therein which generally extend in a forward/rearward direction along the length of the lower portion. The illustrated slots 32, 34 are each substantially straight. Preferably, the lower slot 34 is offset rearward of the upper slot 32 but overlapping the upper slot 32. The lower portion is substantially planar or flat at least in the areas adjacent the slots 32, 34 and the slots 32, 34 are open laterally through the entire thickness of the first and second members 12A, 12B. The slots 32, 34 are sized and shaped for cooperation with the lower pedal arm 16 for substantially linear forward/rearward movement of the pedal 18 relative the upper pedal arm 12 over a desired adjustment range. The adjustment range can be any suitable distance such as, for example, about 76.3 mm or the like. It is noted that the separate upper and lower slots 32, 34 can alternatively be separate portions of a single slot such as a "C-shaped", "S-shaped", or other nonlinear slot.

The upper pedal arm 12 is operatively connected to a control device such as a brake device such that pivotal movement of the upper pedal arm 12 about the pivot axis 14 operates the control device in a desired manner. The illustrated upper pedal arm 12 is provided with the booster or control pin 22 for connection to the control device by a mechanical actuator such as a booster rod 23. The illustrated control pin 22 is operably connected to the upper pedal arm 12 by the adjuster 24 as described in more detail hereinafter so that the control pin 22 pivots with the upper pedal arm 12 when the pedal 18 is depressed so the mechanical actuator secured to the control pin 22 actuates the control device.

The spacer pins extend through openings in each of the first and second members 12A, 12B and secures the first and second members 12A, 12B together. The illustrated spacer pins 30 each have a central portion sized and shaped for spacing the first and second members 12A, 12B apart a desired distance and opposed end portions sized for extending through the openings in the first and second members 12A, 12B. The illustrated spacer pins 30 are rigidly secured by staking the end portions but other suitable connections can be alternatively utilized such as, for example, welding, spring clips, a snap-fit connection, or threaded connection. The illustrated first and second members 12A, 12B are secured by four of the spacer pins 30, two vertically spaced apart at the front edge and to vertically space apart at the rear edge. It is noted that any other suitable locations for the spacer pins 30 and/or any other suitable quantity of the spacer pins can be alternatively utilized within the scope of the present invention. It is also noted that the first and second members 12A, 12B can alternatively be secured in any other suitable manner and/or the upper pedal arm 12 can alternatively take any other suitable form within the scope of the present invention.

The lower pedal arm 16 is preferably formed of steel but can alternatively be formed of any other suitable material such as, for example, plastics like NYLON, aluminum, magnesium, or the like. The illustrated lower pedal arm 16 is formed of an elongate plate oriented in a vertical plane substantially parallel to planes of the first and second members 12A, 12B. The upper end of the lower pedal arm 16 is adapted for movement relative to the upper pedal arm 12 between first and second members 12A, 12B and along the upper and lower slots 32, 34. The upper end of the lower pedal arm 16 is provided with upper and lower guides or guides 36, 38 laterally and horizontally extending therefrom to cooperate with the slots 32, 34 of the first and second members 12A, 12B to form sliding pin-and-slot connections for linearly moving the lower pedal arm 16 relative to the upper pedal arm 12.

The lower end of the lower pedal arm 16 is sized and shaped to carry the rearward-facing pedal 18. The pedal 18 is adapted for depression by the driver of the motor vehicle to pivot the upper pedal arm 12 about the pivot axis 14 to obtain a desired control input to the motor vehicle through the movement of the control pin 22.

The illustrated guides 36, 38 have central portions 40 sized for cooperating with the slots 32, 34 in the first and second members 12A, 12B as described in more detail hereinafter. The illustrated central portions 40 have flat engagement surfaces so that the guides 36, 38 cannot rotate within the slots 32, 34. The illustrated guides 36, 38 are provided with flanges 42 sized to extend between the lower pedal arm 16 and the first and second members 12A, 12B adjacent the slots 32, 34. The flanges 42 are sized and shaped so that there is very little or no lateral movement or "play" for the lower pedal arm 16 between the first and second members 12A, 12B. The guides 12A, 12B are preferably formed of a suitable plastic or polymer material but can alternatively be any other type of suitable wear resistant and/or low friction material or other suitable material.

The central axes of the guides 36, 38 are preferably horizontally offset, that is, the axes of the guides 36, 38 are preferably not in the same vertical plane to provide additional stability to the lower pedal arm 16. In the illustrated embodiment, the lower guide 36 is located rearward of the upper guide 38. The upper and lower guides 36, 38 are spaced apart along the length of lower pedal arm 16 a distance adequate to permit sliding of the guides 36, 38 along the slots 32, 34. The upper and lower guides 36, 38 extend through the slots 32, 34 of the first and second members 12A, 12B so that the lower pedal arm 16 is supported by the first and second members 12A, 12B by contact of the upper and lower guides 36, 38 with bottom bearing surfaces of the slots 32, 34 and the lower pedal arm 16 is movable fore and aft relative to the first and second members 12A, 12B as the upper and lower guides 36, 38 slide along the bottom bearing surfaces of the slots 32, 34. Each guide 36, 38 is in a double shear loading condition because the opposed ends are supported by the first and second members 12A, 12B. It is noted that the upper and lower guides 36, 538 can engage ends of the slots 32, 34 to provide limits to the movement of the lower pedal arm 16 relative to the first and second members 12A, 12B or the drive assembly 20 can provide electronic stops.

The guide slots 32, 34 are preferably sized and shaped such that, as the guides 36, 38 travel along the guide slots 32, 34, the pedal 18 moves along a substantially linear horizontal path. The illustrated guide slots 32, 34 are non-parallel and angled downward in a rearward direction that is the forward end is located higher than the rearward end, to pivot the lower pedal arm 16 as the guides 36, 38 slide along the guide slots 32, 34. The orientation of the pedal 18 somewhat changes as it moves along its substantially linear horizontal path. It should be appreciated that by utilizing inclined or angled guide slots 32, 34, the package size of the control pedal assembly 10 can be optimized for a particular motor vehicle. Particularly, the length of the first and second members 12A, 12B in the forward/rearward direction can be significantly reduced. This is particularly advantageous in compact or midsize motor vehicles having power steering because the available space for the control pedal assembly 10 below the steering column is limited. It is noted, however, that the guide slots 32, 34 can have other configurations such as, for example, horizontal and/or parallel so that the lower pedal arm 16 travels in a horizontal path and/or does not pivot, but there is an increase in the package size of the control pedal assembly 10. It is also noted that in configurations where the lower pedal arm 16 pivots, it may be required in some configurations to have pivotable movement of the drive assembly.

The drive assembly 20 can be of any suitable configuration to selectively move the lower pedal arm 16. For example, the drive assembly can be as described in U.S. Pat. No. 6,509,438, the disclosure of which is expressly incorporated in its entirety by reference, which includes a screw shaft or drive screw, a drive screw attachment or housing for securing the drive assembly 20 to the upper pedal arm 12, a drive nut secured to the lower guide 36 and adapted for movement along the drive screw in response to rotation of the drive screw, an electric motor 44 for rotating the drive screw, and a drive cable 46 for operatively connecting the motor 44 to the drive screw and transmitting rotation motion thereto. It is noted that the drive assembly can alternatively have any other suitable configuration.

The electric motor 44 can be of any suitable type and can be secured to the firewall or other suitable location such as, for example, the mounting bracket 26. The drive cable 46 is preferably a flexible push-pull cable and connects the motor 44 and the forward end of the drive screw so that rotation of the motor 44 rotates the drive screw. It is noted that the drive screw and the motor 44 can be alternatively connected with a rigid connection. An input end of the drive cable 46 is connected to an output shaft of the motor 44 and an output end of the drive cable 46 is connected to an end of the drive screw. It is noted that suitable gearing is provided between the motor 44 and the drive screw as necessary depending on the requirements of the control pedal assembly 10.

Preferably, a controller including processing means and memory means are adapted to control operation of the motor 44. The controller can be a dedicated controller, the motor vehicle control unit, or a controller of another system of the motor vehicle such as, for example, a keyless entry system or a powered seat system. See U.S. patent application Ser. No. 09/492,636, the disclosure of which is expressly incorporated herein in its entirety by reference, for a more detailed description of a suitable control system having a controller.

The adjuster 24 operably connects the control pin 22 to the upper pedal arm 12 to adjust the position of the control pin 22 relative to the pivot axis 14 when the position of the pedal 18 is adjusted so that the ratio (L/R) remains constant as the pedal 18 is adjusted between the forward position and the rearward position. The illustrated adjuster 24 includes a link 48 pivotably secured to the upper pedal arm 12 that is pivoted by movement of the lower pedal arm 16. The control pin 22 is rigidly secured to the link so that the control pin 22 pivots with the link to adjust the distance between the control pin 22 and the pivot axis 14 as the lower pedal arm 16 moves relative to the upper pedal arm 12.

The illustrated link 48 includes an outer link 50 and an inner link 52 rigidly secured together for rotation together. The outer link 50 is pivotably secured to the outer side of the first member 12A at a pivot axis 54 spaced-apart from the pivot axis 14 and located at a rearward end of the upper pedal arm 12. The pivot axis 54 is parallel to and spaced-apart from both the pivot axis of the upper pedal arm 12 and the central axis of the control pin 22. The outer link 50 extends rearwardly to a position forward of the upper pedal arm 12 where it is secured to the inner link 52 by the control pin 22. The inner link 52 is spaced apart from the outer link 50 so that it extends rearwardly between the first and second members 12A, 12B so that it is positioned between the lower pedal arm and the first member 12A.

The illustrated inner link 52 is provided with upper and lower openings or slots 56, 58 that receive the guides 36, 38 therein. The guides 36, 38 thus extend into both the slots 32, 34 of the upper pedal arm 12 and the slots 56, 58 of the inner link. The slots 56, 58 in the inner link 52 are adapted so that the link 48 pivots relative to the upper arm 12 as the guides 36, 38 move along the slots 56, 58 of the upper arm 12 and the slots 56, 58 of the inner link 52 to adjust the position of the control pin 22 to maintain a constant ratio as discussed in more detail hereinafter. The illustrated slots 56, 58 in the inner link 52 are at a shallower angle than the slots 32, 34 in the upper pedal arm 12 when the guides 36, 38 are in their forward most position so that the link 48 is pivoted downward (in a clockwise direction as viewed in FIGS. 2 and 4) about its pivot axis 54.

The inner and outer links 50, 52 are each preferably formed of steel but can alternatively be formed of any other suitable material such as, for example, plastics like NYLON, aluminum, magnesium, or the like. The illustrated inner and outer links 50, 52 are each formed of an elongate plate oriented in a vertical plane substantially parallel to planes of the first and second members 12A, 12B. It is noted, however, that the inner and outer links 50, 52 can alternatively be formed in any other suitable manner.

The illustrated outer link 50 and the lower pedal arm 16 are provided with slides or bushings 62, 64 that are provided with flanges sized to extend between the outer link 50 and the upper pedal arm 12 and the lower pedal arm 16 and the inner link 52. The flanges are sized and shaped so that there is very little or no lateral movement or "play" between the components. The bushings 62, 64 are preferably formed of a suitable plastic or polymer material but can alternatively be any other type of suitable wear resistant and/or low friction material or other suitable material.

To adjust the control pedal assembly 10, the driver engages a control switch which activates rotation of the motor 44 in the desired direction. Rotation of the motor 44 rotates the drive screw through the drive cable 46 and causes the drive nut to axially move along the drive screw in the desired direction. The drive nut moves along the drive screw and drives the lower guide 38 along the lower slots 34. As the lower guide 38 slidingly moves along the lower slots 34, the lower pedal arm 16 is moved therewith to adjust the forward/rearward position of the pedal 18. As the lower pedal arm 16 moves, the upper guide 36 slides along the upper slots 32. With such movement, the pedal 18 travels in a substantially linear and horizontal path, that is, the pedal 18 moves in a forward/rearward direction and generally remains at the same height relative to the fixed mounting bracket 26 (best shown in FIG. 5) and the upper pedal arm 12 does not move relative the mounting bracket 26 during adjustment of the pedal 18. The lower pedal arm 16 pivots as it moves so that the orientation of the pedal 18 slightly changes. This change in orientation of the pedal 18 is typically too small to be detected by the motor vehicle operator.

Figure 3:
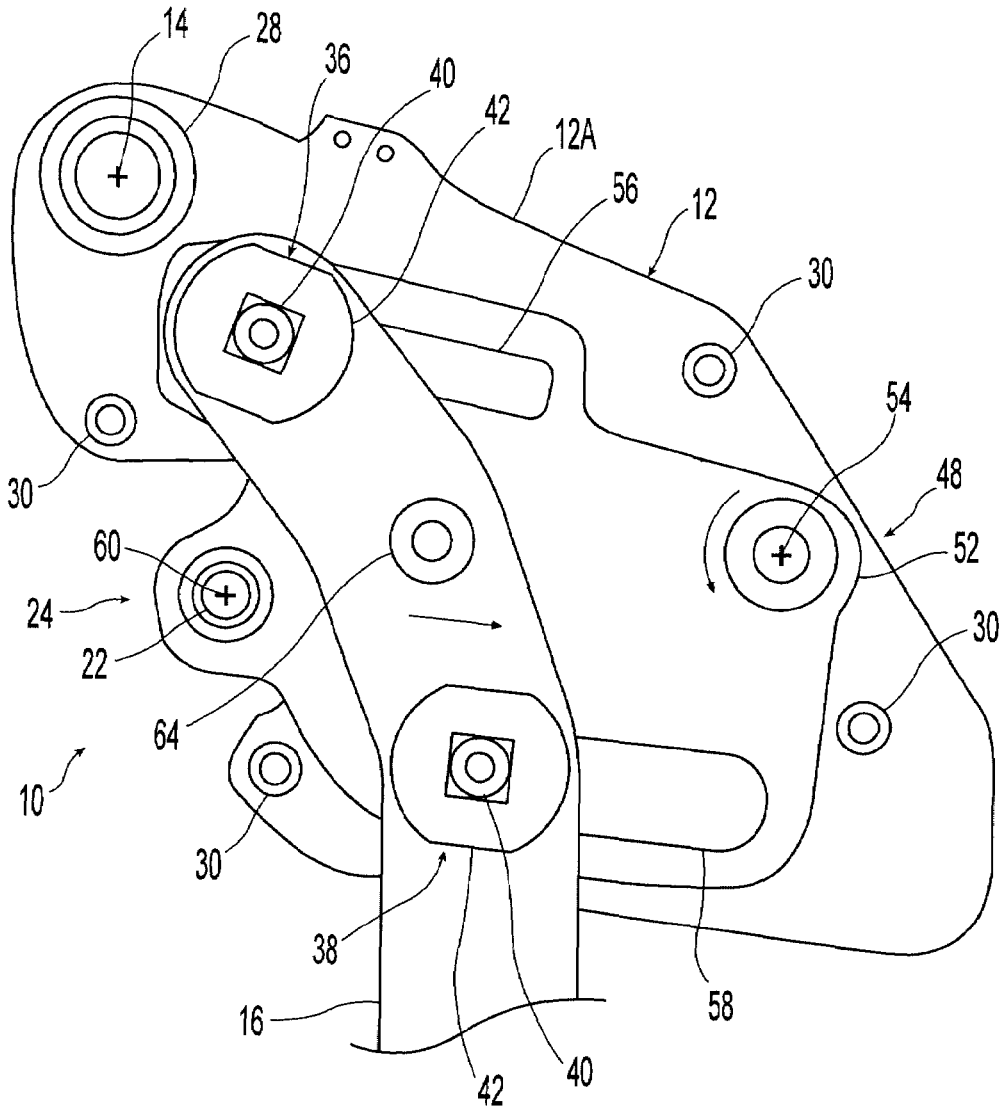
FIG. 3 is a fragmented, left side elevational view of the adjustable pedal system of FIGS. 1 and 2, wherein a portion of an upper arm is removed for clarity.
Figure 4:
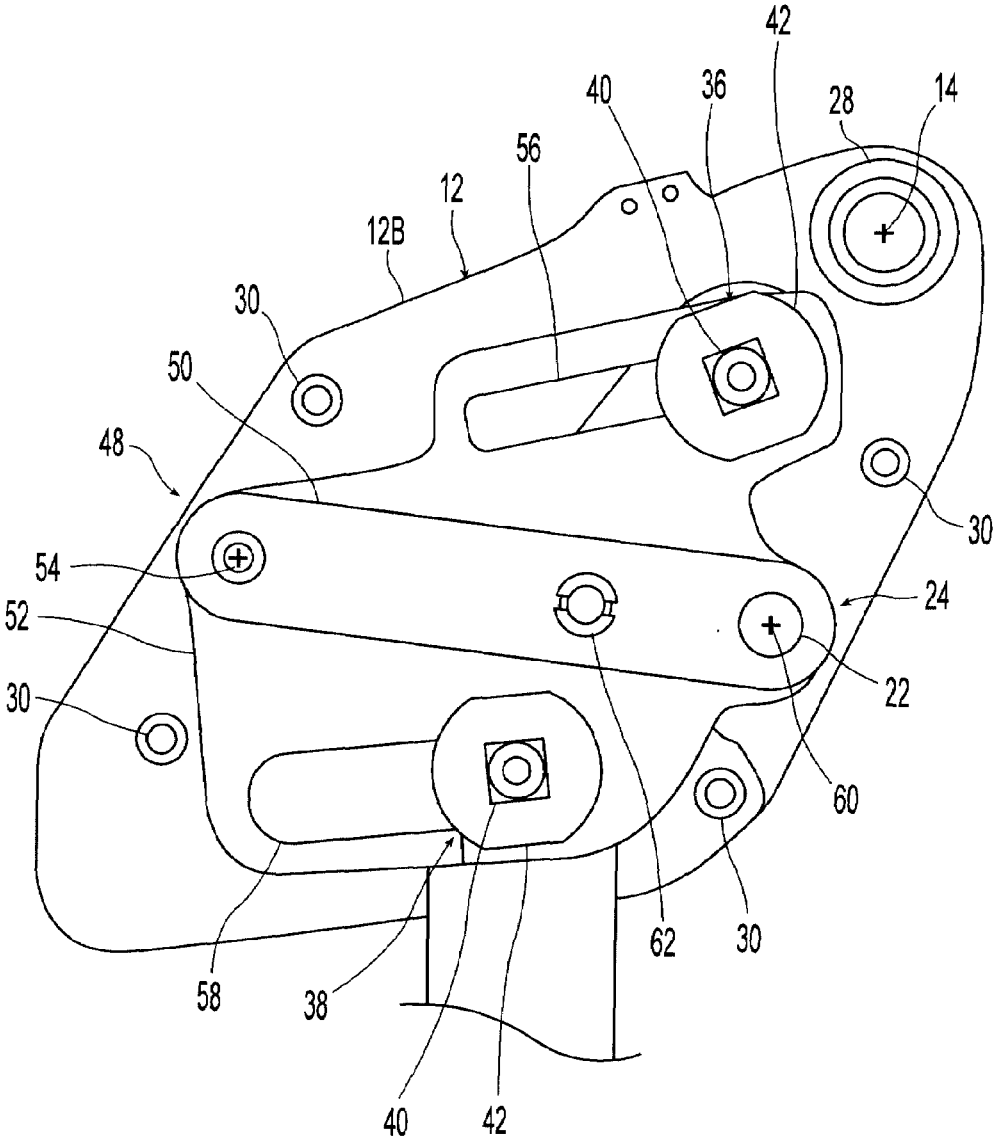
FIG. 4 is a fragmented, right side elevational view of the adjustable pedal system of FIGS. 1 to 3, wherein a portion of the upper arm is removed for clarity.

As the guides 36, 38 slide along the slots 32, 34 of the upper pedal arm 12 to adjust the position of the pedal 18, the guides also slide along the slots 56, 58 of the inner link 52 to pivot the link 48 to adjust the position of the control pin 22 so that the ration remains constant. When the lower pedal arm 16 is in its rearward most position (shown in FIGS. 2 to 4) and is moved in a rearward direction, the guides 36, 38 drive the slots 56, 58 of the inner link 52 down so that the link 48 pivots about its pivot axis 54 (in a counterclockwise direction as seen in FIG. 3) to proportionally move the control pin 22 further from the pivot axis 14 of the upper pedal arm 12 a distance to account for the increased distance between the pivot axis 14 of the upper pedal arm 12 and the pedal 18 caused by the pedal being moved in the rearward direction. In this manner, the ratio is maintained constant throughout the movement of the pedal 18 between its forward most position and its rearward most position. It is noted that the booster pin 23 or the connection between the booster pin 23 and the control pin 22 can accommodate the movement of the control pin 22 in any suitable manner.

Figure 5:
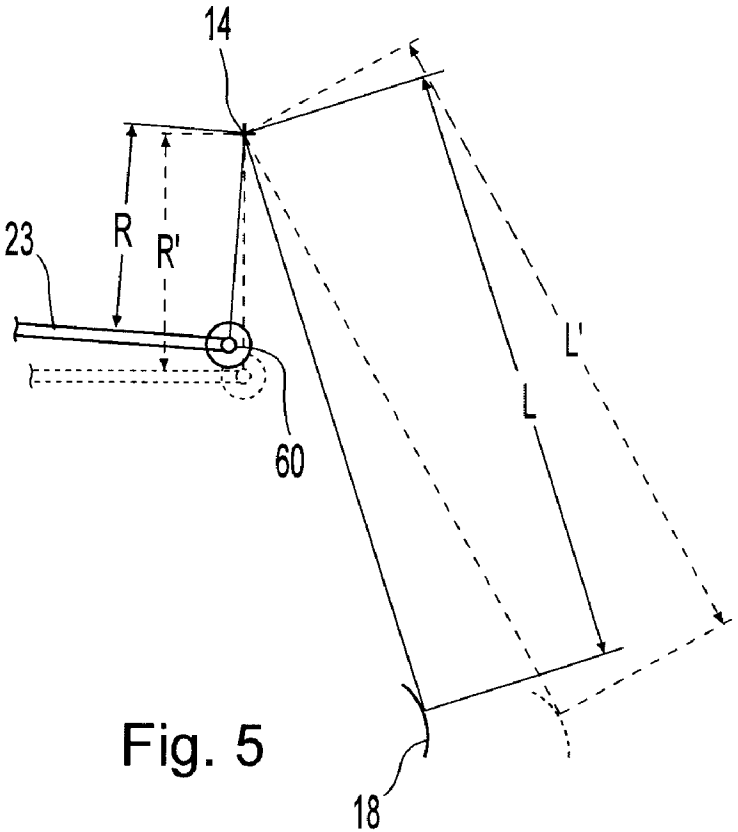
FIG. 5 is diagrammatic view of the adjustable pedal system of FIGS. 1 to 4 showing how the ratio remains constant as the pedal is adjusted between a full forward position and a full rearward position.

As best shown n FIG. 5, the ratio of the distance (L) between the pivot axis 14 and the pedal 18 and the distance between the pivot axis 14 and the central axis 60 of the control pin 22 is maintained by the adjuster 24 as the pedal is moved between its forward most and rearward most positions. For example, if distance L is 387.23 mm and distance R is 81.52 mm when the pedal 18 is in its forward most position (so that the ration is 4.75) and distance L is 423.91 mm when the pedal 18 is in its rearward most position, distance R is proportionally adjusted to 89.25 when the pedal 18 is in its rearward most position (so that the ration is 4.75) so that the ratio remains constant. It is doted that the distances (L, R) can alternatively be any suitable lengths within the scope of the present invention.

From the foregoing disclosure and detailed description of certain preferred embodiments, it is apparent that the adjustable pedal assembly 10 maintains a constant ratio so that there is a constant initial pedal force throughout the pedal adjustment range and is relatively simple and inexpensive to produce without an overly large package size.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. An adjustable control pedal comprising, in combination:

a fixed position mounting bracket;

an upper arm pivotably secured to the mounting bracket at a stationary pivot axis;

wherein the stationary pivot axis does not move relative to the mounting bracket;

a lower arm carrying a pedal and operably connected to the upper arm so that the lower arm pivots the upper arm about the pivot axis when force is applied to the pedal;

a drive assembly operatively connected to said lower arm for moving the lower pedal arm relative to the upper pedal arm to adjust the position of the pedal between the forward and rearward positions;

a control pin operably connected to the upper arm for rotation with the upper arm as the upper arm pivots about the pivot axis when force is applied to the pedal;

an adjuster operably connected to the control pin to adjust the position of the control pin relative to the pivot axis so that a ratio of a distance between the pivot axis and the pedal and a distance between the pivot axis and the control pin remains constant as the pedal is adjusted between the forward position and the rearward position; and wherein the adjuster includes a link pivotably attached to the upper arm, the control pin is secured to the link and moves with the link relative to the upper arm as the link pivots relative to the upper arm, and movement of the lower arm relative to the upper arm pivots the link so that the ratio remains constant.

2. The adjustable control pedal according to claim 1, wherein the upper arm has first and second spaced-apart slots formed therein and guides operably secured to the lower arm that extend into the first and second slots respectively, and the guides move along the first and second slots of the upper arm as the lower arm is selectively moved relative to the upper arm.

3. The adjustable control pedal according to claim 2, wherein the link has first and second spaced-apart slots formed therein, the guides extend into the first and second slots of the link respectively, and the guides move along the first and second slots of the link as the lower arm is selectively moved relative to the upper arm.

4. The adjustable control pedal according to claim 3, wherein the slots in the link are adapted so that the link pivots relative to the upper arm as the guides move along the slots of the upper arm and the slots of the link.

5. The adjustable control pedal according to claim 1, wherein the upper arm includes first and second spaced-apart members each having first and second slots therein, guides are operably secured to the lower arm that extend into the first and second slots respectively, the lower arm extends between the first and second members with the guides extending between the first and second members, and the guides move along the first and second slots of the upper arm as the lower arm is selectively moved relative to the upper arm.

6. The adjustable control pedal according to claim 5, wherein the link includes an inner link and an outer link rigidly secured together, the inner link extends between the first and second members, and the outer link is located outside the first and second members.

7. The adjustable control pedal according to claim 6, wherein the outer link is pivotably attached to the upper arm, the inner link has first and second spaced-apart slots formed therein, the guides extend into the first and second slots of the inner link respectively, and the guides move along the first and second slots of the inner link as the lower arm is selectively moved relative to the upper arm.

8. The adjustable control pedal according to claim 7, wherein the slots in the inner link are adapted so that the link pivots relative to the upper arm as the guides move along the slots of the upper arm and the slots of the inner link.

9. An adjustable control pedal comprising, in combination:

a fixed position mounting bracket;

an upper arm pivotably secured to the mounting bracket at a stationary pivot axis;

wherein the stationary pivot axis does not move relative to the mounting bracket;

a lower arm carrying a pedal and operably connected to the upper arm so that the lower arm pivots the upper arm about the pivot axis when force is applied to the pedal;

a drive assembly operatively connected to said lower arm for moving the lower pedal arm relative to the upper pedal arm to adjust the position of the pedal between the forward and rearward positions;

a link pivotally attached to the upper arm;

a control pin secured to the link for providing a control signal and moving with the link relative to the upper arm as the link pivots relative to the upper arm; and wherein movement of the lower arm relative to the upper arm pivots the link to adjust the position of the control pin relative to the pivot axis so that a ratio of a distance between the pivot axis and the pedal and a distance between the pivot axis and the control pin remains constant as the pedal is adjusted between the forward position and the rearward position.

10. The adjustable control pedal according to claim 9, wherein the upper arm has first and second spaced-apart slots formed therein and guides operably secured to the lower arm that extend into the first and second slots respectively, and the guides move along the first and second slots of the upper arm as the lower arm is selectively moved relative to the upper arm.

11. The adjustable control pedal according to claim 10, wherein the link has first and second spaced-apart slots formed therein, the guides extend into the first and second slots of the link respectively, and the guides move along the first and second slots of the link as the lower arm is selectively moved relative to the upper arm.

12. The adjustable control pedal according to claim 11, wherein the slots in the link are adapted so that the link pivots relative to the upper arm as the guides move along the slots of the upper arm and the slots of the link.

13. The adjustable control pedal according to claim 9, wherein the upper arm includes first and second spaced-apart members.

14. The adjustable control pedal according to claim 13, wherein the link includes an inner link and an outer link rigidly secured together.

15. The adjustable control pedal according to claim 14, wherein the inner link extends between the first and second members and the outer link is located outside the first and second members.

16. The adjustable control pedal according to claim 15, wherein the outer link is pivotably attached to the upper arm.

17. An adjustable control pedal comprising, in combination:

a fixed position mounting bracket;

an upper arm pivotably secured to the mounting bracket at a stationary pivot axis;

a lower arm carrying a pedal and operably connected to the upper arm so that the lower arm pivots the upper arm about the pivot axis when force is applied to the pedal;

a drive assembly operatively connected to said lower arm for moving the lower pedal arm relative to the upper pedal arm to adjust the position of the pedal between the forward and rearward positions;

wherein the upper arm includes first and second spaced-apart members each having first and second slots therein;

guides operably secured to the lower arm that extend into the first and second slots of the upper arm respectively that move along the first and second slots of the upper arm as the lower arm is selectively moved relative to the upper arm;

wherein the lower arm extends between the first and second members with the guides extending between the first and second members, and the guides;

a link pivotally attached to the upper arm;

a control pin secured to the link for providing a control signal;

wherein movement of the lower arm relative to the upper arm pivots the link to adjust the position of the control pin relative to the pivot axis so that a ratio of a distance between the pivot axis and the pedal and a distance between the pivot axis and the control pin remains constant as the pedal is adjusted between the forward position and the rearward position;

wherein the link includes an inner link and an outer link rigidly secured together;

wherein the outer link is located outside the first and second members and is pivotably attached to the upper arm;

wherein the inner link extends between the first and second members and has first and second spaced-apart slots formed therein; and wherein the guides extend into the first and second slots of the inner link respectively, and the guides move along the first and second slots of the inner link as the lower arm is selectively moved relative to the upper arm to rotate the link relative to the upper arm.

* * * * *